US005671490A

United States Patent [19]

Wu

[11] Patent Number: 5,671,490

[45] Date of Patent: Sep. 30, 1997

[54] COLLAPSIBLE BED RAIL STRUCTURE

[76] Inventor: Sung-Tsun Wu, 8F-1, No. 249, Chung Ching Road, Pan Chiao City, Taipei Hsien, Taiwan

[21] Appl. No.: 748,405

[22] Filed: Nov. 13, 1996

[51] Int. Cl.[6] ..... A47C 21/08

[52] U.S. Cl. ..... 5/426; 05/430

[58] Field of Search ..... 5/425, 426, 427, 5/430, 99.1

[56] References Cited

U.S. PATENT DOCUMENTS

| | | | |
|---|---|---|---|
| 4,833,743 | 5/1989 | Howell et al. | 5/426 |
| 5,367,725 | 11/1994 | Tsai | 5/99.1 |
| 5,483,710 | 1/1996 | Chan | 5/99.1 |
| 5,485,655 | 1/1996 | Wang | 5/99.1 |
| 5,530,977 | 7/1996 | Wang | 5/99.1 |
| 5,596,776 | 1/1997 | Huang | 5/426 |

FOREIGN PATENT DOCUMENTS

| | | | |
|---|---|---|---|
| 622912 | 6/1961 | Canada | 5/426 |
| 2225716 | 6/1990 | United Kingdom | 5/426 |

*Primary Examiner*—Michael F. Trettel
*Attorney, Agent, or Firm*—Browdy and Neimark

[57] ABSTRACT

A collapsible bed rail includes two spaced upright rods having an upper end to which an upper corner joint is fixed and a lower end to which a lower corner joint is pivoted so as to allow the upright rods to be rotatable among an expanded position, a collapsed position and a rail open position. An upper horizontal rod comprised of two sections pivotally jointed to each other by means of an upper central joint is pivoted at two opposite ends thereof to the upper corner joints. A lower horizontal rod comprised of two sections pivotally jointed to each other by means of a knuckle joint structure is releasably fixed at two opposite ends thereof to the lower corner joints. A transverse bar extends from each of the lower corner joints in a direction substantially normal to the respective upright rod and the lower horizontal rod to be disposed and held under a matrix so as to mount the bed rail to the bed on which the matrix is placed. A resilient cover sheet member is arranged within the upper and lower horizontal rods and the upright rods.

18 Claims, 9 Drawing Sheets

COLLAPSIBLE BED RAIL STRUCTURE

FIELD OF THE INVENTION

The present invention relates to a bed rail to be removably mounted to a bed and in particular to a collapsible bed rail structure.

BACKGROUND OF THE INVENTION

Baby cots with side rail for preventing babies from falling out of the cots are known. The conventional baby cots usually take a great space. This is a problem especially for small house as the space may be very limited. Placing young babies on regular beds, however, is something very dangerous for they may accidently fall out of the beds and hurt themselves. Removable bed rails are thus developed to prevent the babies from falling out of the beds. The conventional removable bud rails are not collapsible and are not designed to allow parents to pick up the babies in a very easy way without removing the bed rail.

In view of these drawbacks, it is desirable to provide a collapsible bed rail structure adapted to be mounted to a regular bed in a removable manner which is configured to overcome the drawbacks of the prior art designs.

SUMMARY OF THE INVENTION

The principal object of the present invention is to provide a collapsible bed rail structure which overcomes the drawbacks of the prior art.

It is another object of the present invention to provide a removable, collapsible bed rail which is readily mounted to a regular bed.

It is a further object of the present invention to provide a collapsible bed rail which allow the rail to be moved to a rail open position where allows parent to pick up young children from the bed without removing the bed rail.

In accordance with the present invention, there is provided a collapsible bed rail comprising two spaced upright rods having an upper end to which an upper corner joint is fixed and a lower end to which a lower corner joint is pivoted so as to allow the upright rods to be rotatable among an expanded position, a collapsed position and a rail open position. An upper horizontal rod comprised of two sections pivotally jointed to each other by means of an upper central joint is pivoted At two opposite ends thereof to the upper corner joints. A lower horizontal rod comprised of two sections pivotally jointed to each other by means of a knuckle joint structure is releasably fixed at two opposite ends thereof to the lower corner joints. A transverse bar extends from each of the lower corner joints in a direction substantially normal to the respective upright rod and the lower horizontal rod to be disposed and held under a matrix so as to mount the bed rail to the bed on which the matrix is placed. A resilient cover sheet member is arranged within the upper and lower horizontal rods and the upright rods.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
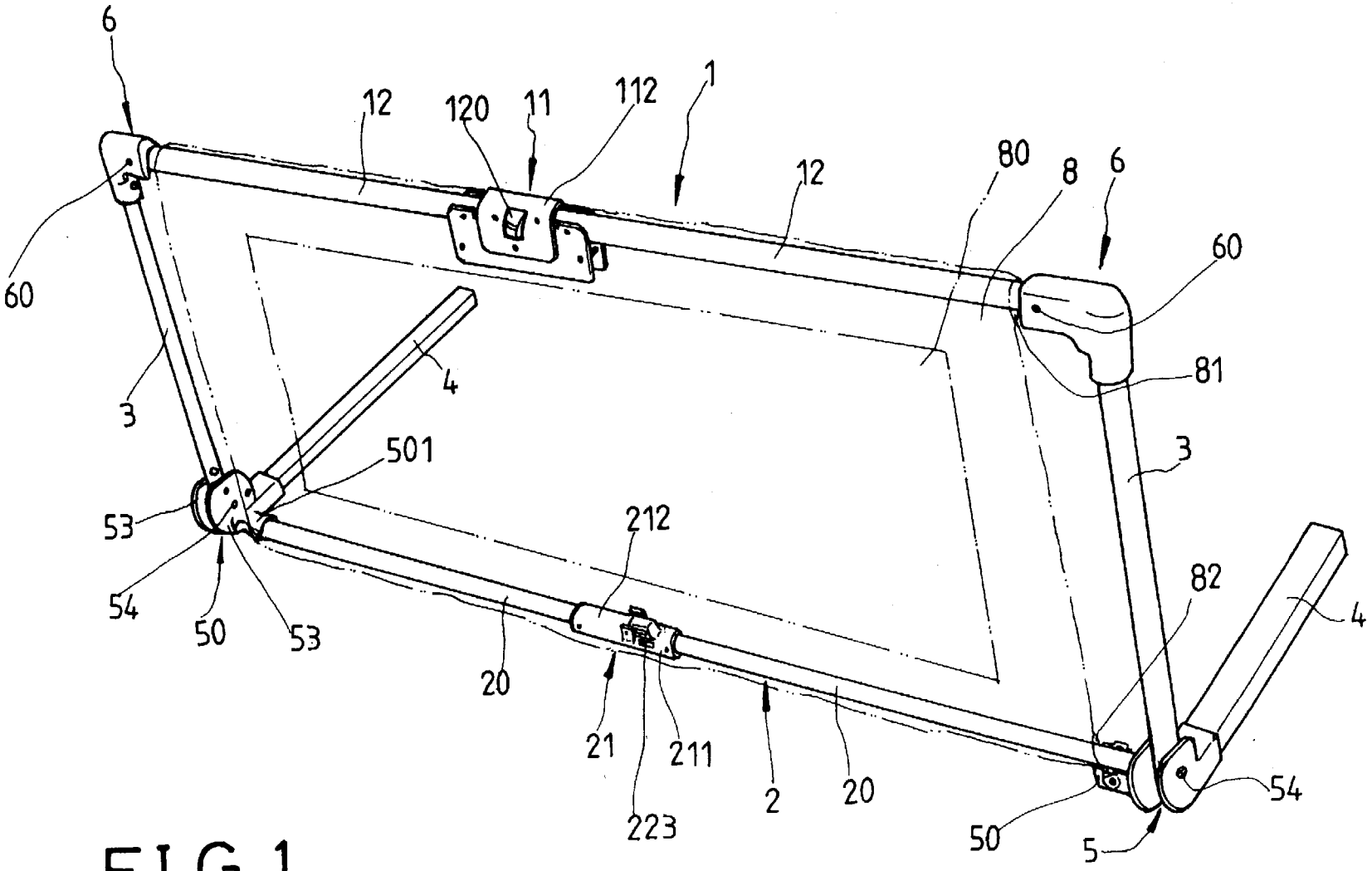
FIG. 1 is a perspective view showing a collapsible bed rail constructed in accordance with the present invention in the expanded condition.
Figure 10:
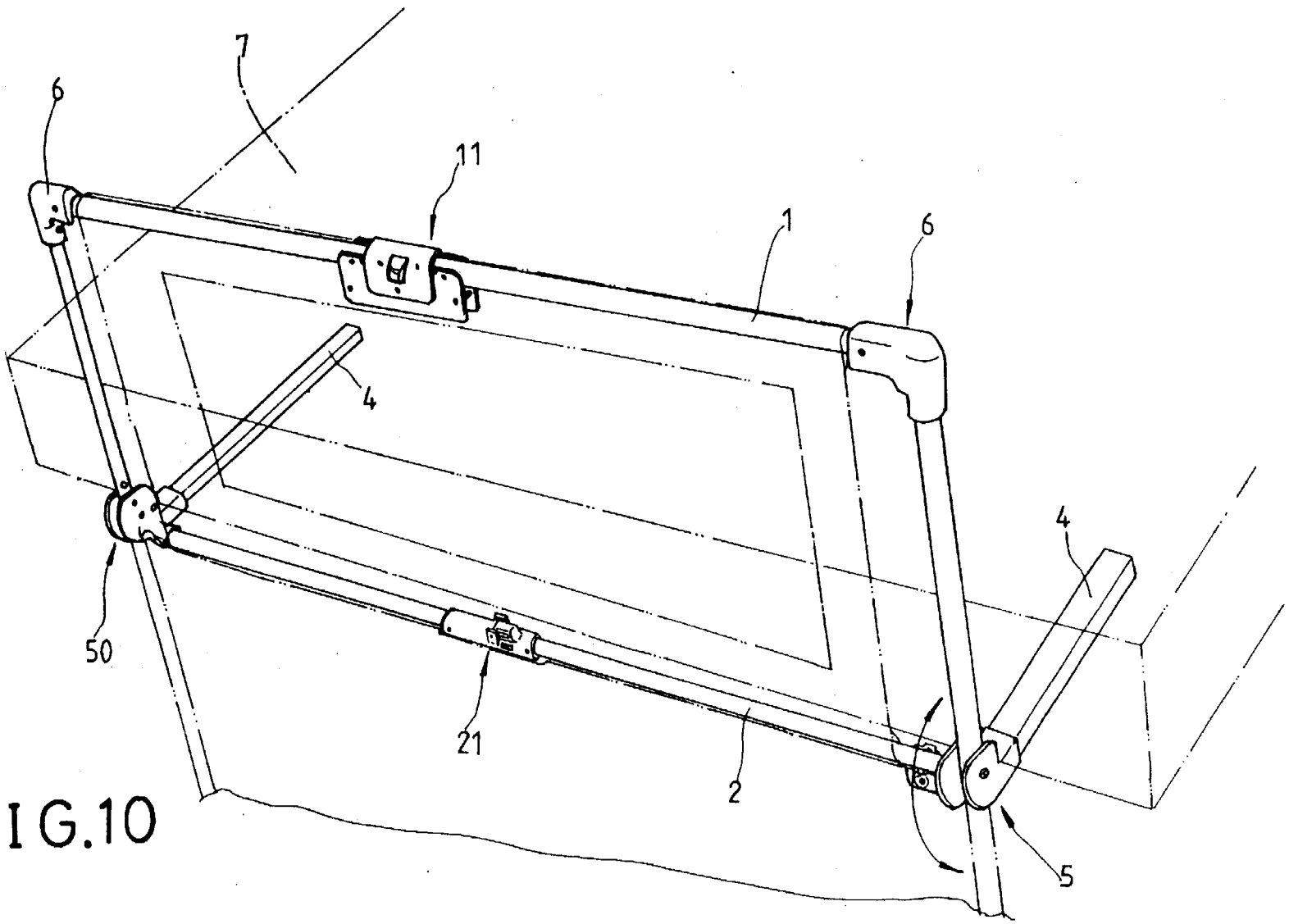
FIG. 10 is a perspective view showing the installation of the bed rail of the present invention in a regular bed.

With reference to the drawings and in particular to FIG. 1, wherein a collapsible bed rail constructed in accordance with the present invention is shown in an expanded condition, the bed rail comprises two upright rods 3, each having an upper end to which an upper corner joint 6 is mounted and a lower end to which a first lower corner joint 5 or a second lower corner joint 50 is mounted. The bed rail of the present invention further comprises an elongated upper horizontal rod 1 comprised of two sections 12 rotatably jointed to each other at inner ends thereof by means of an upper central joint 11. The two sections 12 of the upper horizontal rod 1 have outer ends pivoted to the two upper corner joints 6 at 60. An elongated lower horizontal rod 2, also comprised of two sections 20 rotatably connected to each other at inner ends thereof by means of a lower central joint 21, has two outer ends respectively connected to the two lower corner joints 5 and 50 in a releasable manner to be further described. The upright rods 3, the upper horizontal rod 1 and the lower horizontal rod 2 together define a rectangle when expanded, as shown in FIG. 1, which is sized to be fixed beside a bed or a matrix 7, as shown in FIG. 10.

It should be noted that the term "horizontal" as used herein in intended to indicate a direction substantially parallel with the matrix 7 which is normally placed on a plane parallel with the horizon, while the term "upright" indicates a direction normal to the plane of the matrix 7.

Figure 8:
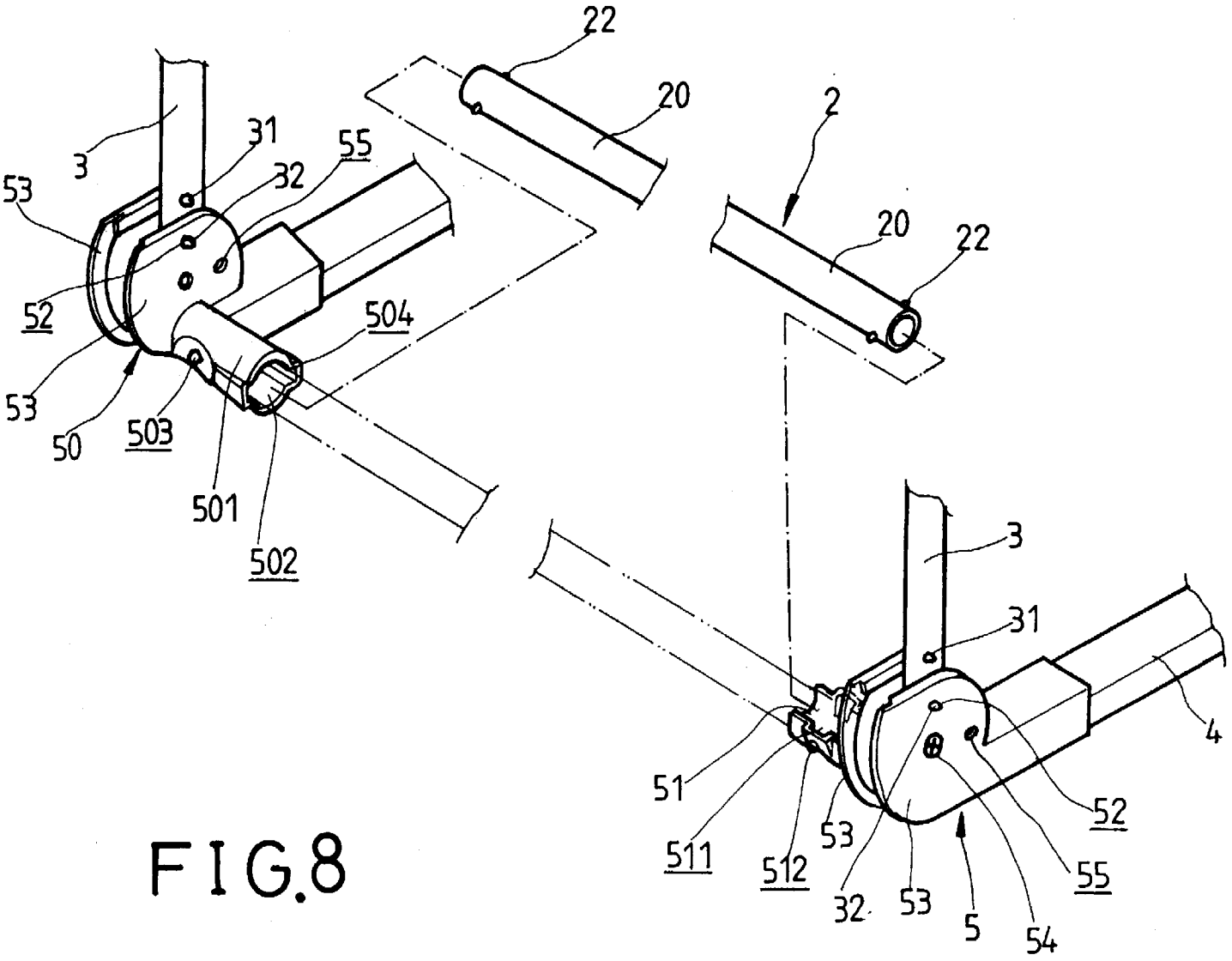
FIG. 8 is a perspective view of a portion of the collapsible bed rail in the expanded condition, illustrating the connection between the lower horizontal rod and two lower corner joints.
Figure 9:
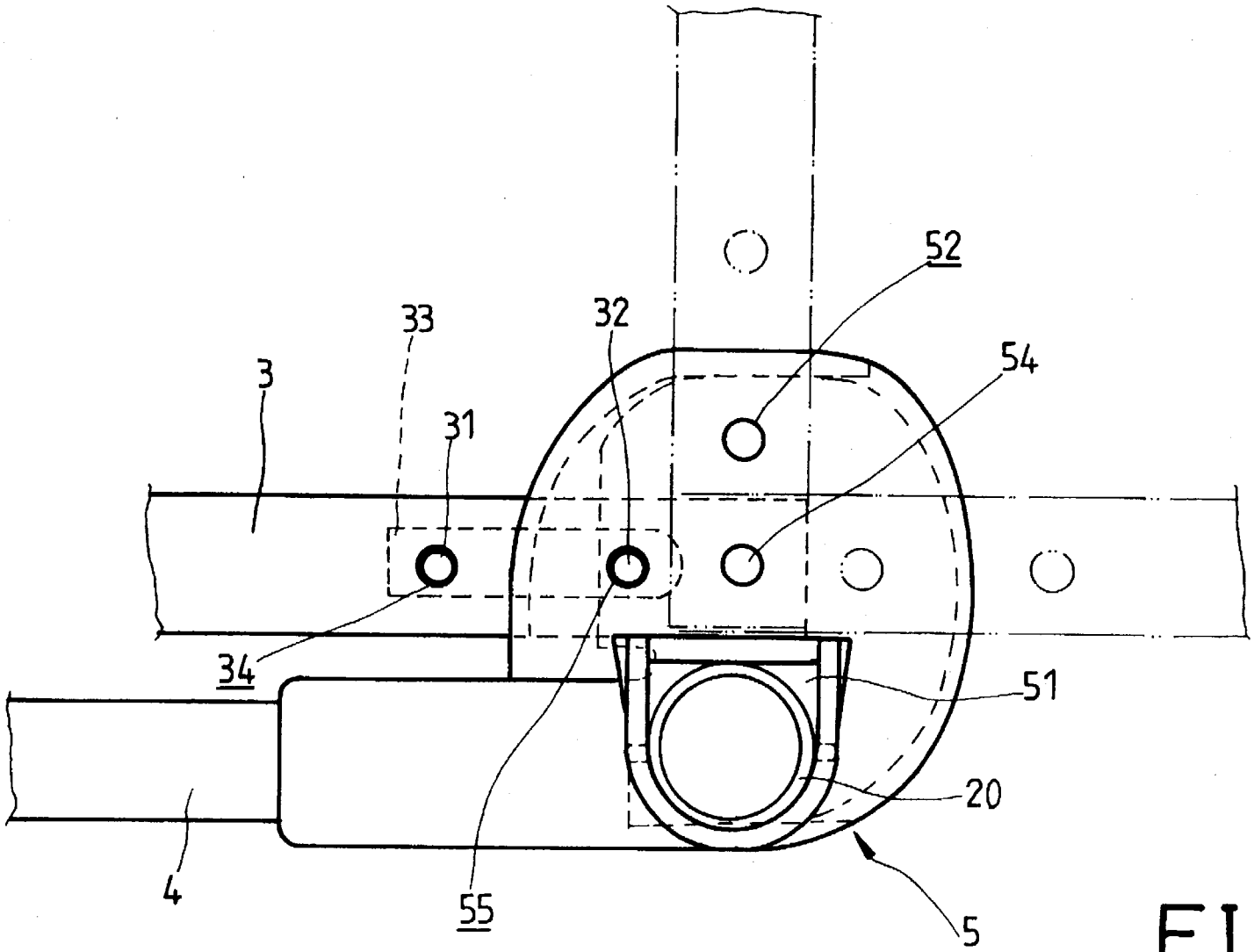
FIG. 9 is a side view showing one of the lower corner joints.

Referring to FIGS. 1, 8 and 9, which show the pivotal connection between the upright rods 3 and the first and second lower corner joints 5 and 50, since the pivotal connection between the upright rod 3 and the first lower corner joint 5 is substantially the same as that between the upright rod 3 and the second lower corner joint 50, only the pivotal connection between the upright rod 3 and the first lower corner joint 5 will be given and this is also applicable to the second lower corner joint 50.

The first lower corner joint 5 comprises two spaced walls 53 define therebetween a gap for receiving the lower end of the respective upright rod 3 therein. A pivot 54 extends through the two walls 53 and the lower end of the upright rod 3 to pivot the upright rod 3 to the first lower corner joint 5 in such a manner to allow the upright rod 3 to rotate at least half a full turn about the pivot 54 within the gap defined between the walls 53, as indicated by phantom lines in FIG. 9.

A retractable retainer pin 32 is received within the upright rod 3 and spring-biased to partially project out of the upright rod 3 to be receivable within a first hole 52 that is formed on one of the walls 53 and located so that when the pin 32 is received within the first hole 52, the upright rod 3 is positioned and retained upright (normal to the lower horizontal rod 2) and in the expanded condition, as shown in FIG. 1 or phantom lines of FIG. 9.

In accordance with the present invention, the retractable retainer pin 32 is fixed on biasing means or spring plate 33 to be biased outward. A control peg 31, which is substantially identical to the retainer pin 32 in shape and size in the embodiment illustrated, but may be different, is also provided on the spring plate 33 to be biased outward as the retainer pin 32, preferably through a hole 34 formed on the upright rod 3, to be accessible and depressible by a user. By depressing the control peg 31 against the spring plate 33, the retainer pin 32 is retracted into the upright rod 3 so as to release the upright rod 3 from the first hole 52 of the first lower corner joint 5.

Figure 2:
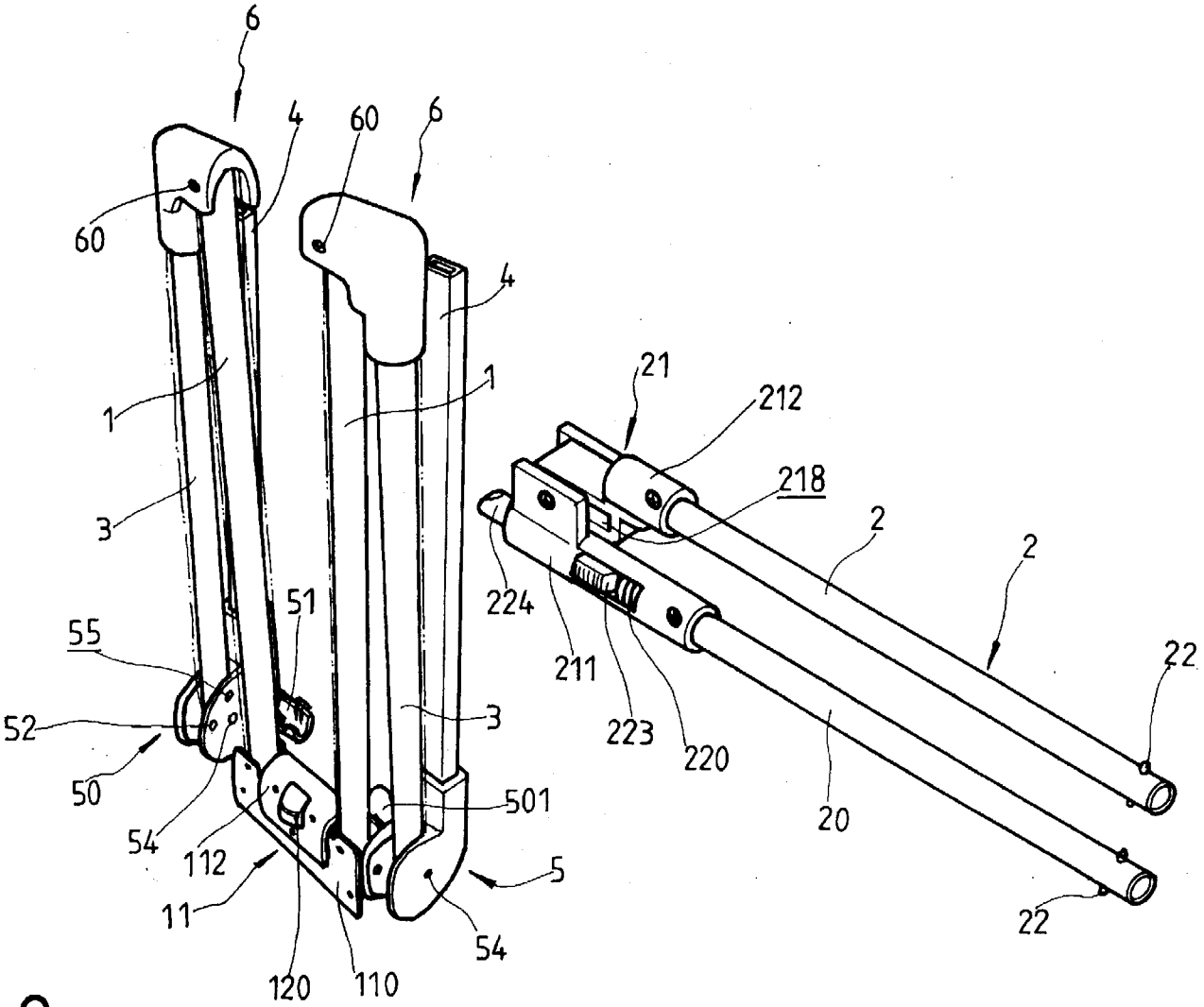
FIG. 2 is a perspective view showing the collapsible bed rail in the collapsed condition.

The first lower corner joint 5 is also provided with a second hole 55 on the one of the walls 53 on which the first hole 52 is formed to be located at a radial position from the pivot 54 substantially the same as the first hole 52 to receive the retainer pin 32 therein when the upright rod 3 is rotated to a collapsed condition as shown in FIG. 2 or solid lines of FIG. 9.

The first lower corner joint 5 comprises a support-member 51 formed on one of the walls 53 thereof and extending laterally toward the second lower corner joint 50 for receiving and supporting one of the outer ends of the lower horizontal rod 2 therein. Correspondingly, the second lower corner joint 50 comprises a support tube 501 formed on one of the walls 53 of the second lower corner joint 50 and extending toward the first lower corner joint 5 to receive and retain the other outer end of the lower horizontal rod 2 therein.

The support tube 501 has an open end 502 for the entry of the respective outer end of the lower horizontal rod 2. The support tube 501 comprises two holes 503 to receive therein two spring-biased retainer pins 22 provided inside and partially projecting out of the rod 2 for retaining the lower horizontal rod 2. The spring-loaded configuration of the retainer pins 22 allows these pins 22 to be retracted by applying an external force thereon against the spring so as to release the lower horizontal rod 2 from the support tube 501.

Preferably, the support tube 501 is provided with two opposite, inclined guide slots 504 which diverge toward and extend to the open end 502 of the support tube 501 to facilitate entry of the retainer pins 22 of the lower horizontal rod 2 into the support tube 501.

The support member 51 mounted to the first lower corner joint 5 defines an open channel 51 with an open upper side defined by two opposite edges for directly receiving the respective outer end of the lower horizontal rod 2 therein. The support member 51 is provided with two circumferentially extending slots 511 which also have a diverging configuration extending toward the two opposite edges for the entry of retainer pins 22 provided inside and partially radially projecting out of the outer end of the lower horizontal rod 2. The retainer pins 22 are also spring-biased to be received within holes 512 formed on the support member 51 to retain the lower horizontal rod 2 within the support member 51 in a releasable manner.

Each of the first and second lower corner joints 5 and 50 comprises a transverse bar 4 fixed thereto and extending in a direction substantially normal to both the upright rod 3 and the lower horizontal rod 2 in the expanded condition. The transverse bars 4 are to be placed under the matrix 7 and thus held between the matrix 7 and the bed, as shown in FIG. 10.

Figure 3:
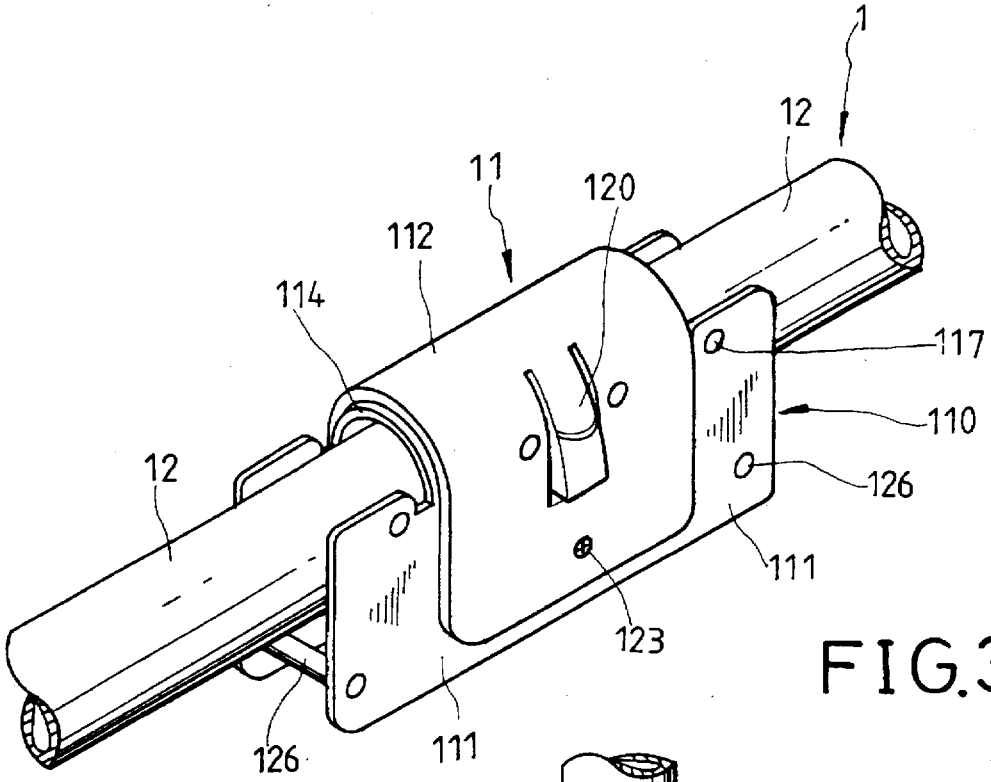
FIG. 3 is a perspective view showing an upper central joint for an upper horizontal rod, in the expanded condition, that constitutes the bed rail of the present invention.
Figure 4:
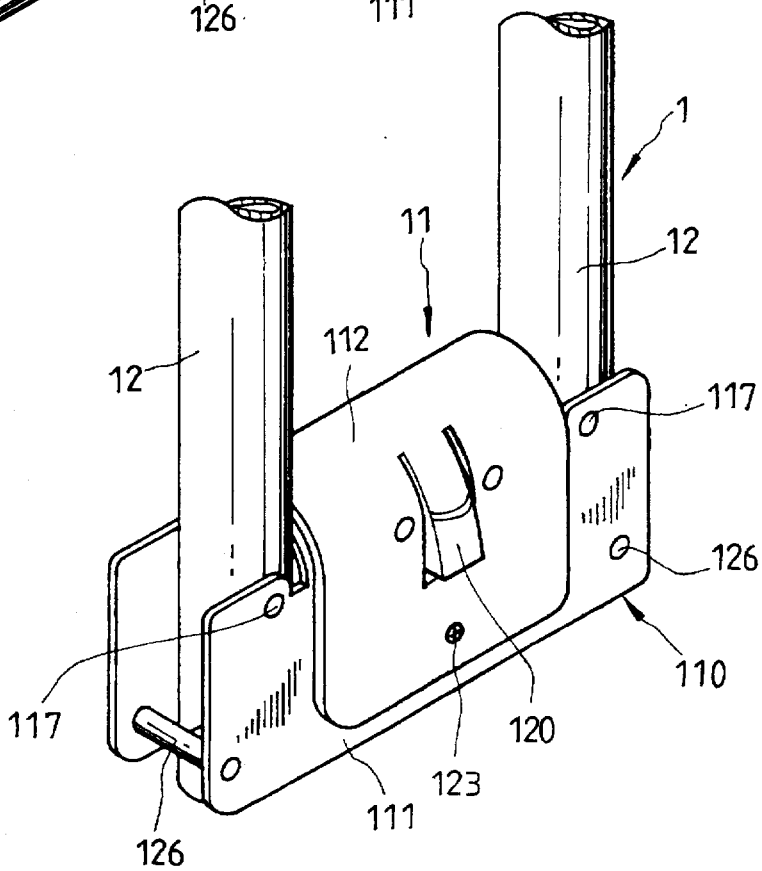
FIG. 4 is a perspective view showing the upper central joint of the upper horizontal rod in the collapsed condition.
Figure 5:
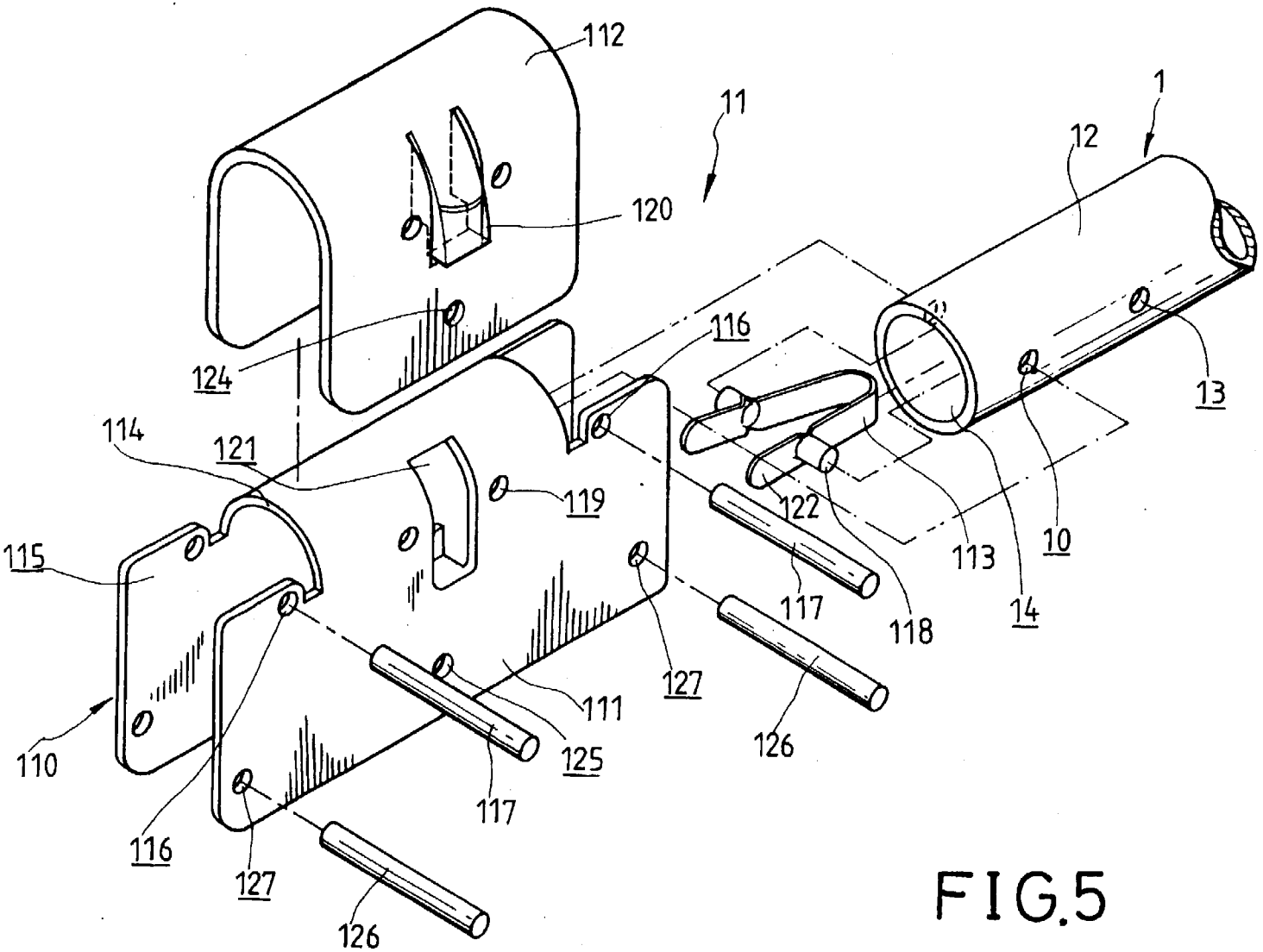
FIG. 5 is an exploded perspective view showing the upper central joint of the upper horizontal rod.

With particular reference to FIGS. 3–5, the upper central joint 11 comprises a joint body 110 which is a hollow member having a U-shaped cross section defined by two spaced side panels 111 connected to each other with a saddle section 114. Each of the side panels 111 comprises two end extensions extending beyond the saddle connection 114 so as to define two notches 115 between the side panels 111.

Each of the side panels 111 has a hole 116 formed on each of the end extensions thereof. The holes 116 are located so that the holes 116 are aligned with each other between the two side panels 111 to receive a pivot 117 extending therethrough. The pivot 117 also extends through a hole 13 formed on one of the sections 12 of the upper horizontal rod 1 which is received between the side panels 111 so as to pivot the section 12 to the upper central joint 11.

The section 12 of the upper horizontal rod 1 comprises a hollow end 14 within which resilient means, such as a U- or V-shaped leaf spring 113 is received and retained. The leaf spring 113 has two spaced legs, each having formed thereon a sideways projection 118. The projections 118 extend in opposite directions and partially projecting out of the section 12 through two holes 10 formed on the hollow end 14 of the section 12 by being biased by the leaf spring 113. Corresponding to the two holes 10, the side panels 111 of the upper central joint 11 are each provided with a hole 119 into which the projections 118 that partially project out of the holes 10 of the section 12 are received in a releasable manner. The holes 119 are located so that when the projections 113 are received therein, the section 12 of the upper horizontal rod 1 is in the expanded condition and thus the two sections 12 that are connected to the upper central joint 11 are substantially aligned with each other, as shown in FIG. 3.

A releaser 112 is provided to release the sections 12 from the expanded condition shown in FIG. 3 and to allow the sections 12 of the upper horizontal rod 1 to be moved into the notches 115 and thus folded into the collapsed condition shown in FIG. 4. The releaser 112 is a substantially U-shaped member to be fit over the saddle connection 114 of the upper central joint 11. The releaser 112 comprises two movable tabs 120 which is manually deformable from two opposite directions so as to move into two openings 121 formed on the joint body 110. The leaf spring 113 is so sized that two free ends 122 of the legs thereof are located within the openings 121 of the joint body 110 to be contacted by the tabs 120 and thus the manually deformed tabs 120 of the releaser 112 forces the free ends 122 of the leaf spring 113 inward to release the projections 118 from the holes 119. This releases the sections 12 of the upper horizontal rod 1 from the expanded condition.

The releaser 112 may be secured to the joint body 110 by means of a bolt 123, see FIGS. 3 and 4, which extends through holes 124 formed on the releaser 112 and holes 125 formed on the joint body 110.

The upper central joint 11 is also provided with stops 126 which are in the form of pins in the embodiment illustrated to stop the sections 12 at predetermined collapsed positions in collapsing the bed rail. The stop pins 126 extend through and are retained in holes 127 formed on the side panels 111 of the joint body 110 and the holes are located so that when the sections 12 reach the predetermined collapsed positions, the sections 12 are brought into contact engagement with the stop pins 126 so as to stop the movement of the sections 12 at the collapsed condition shown in FIG. 4.

Figure 6:
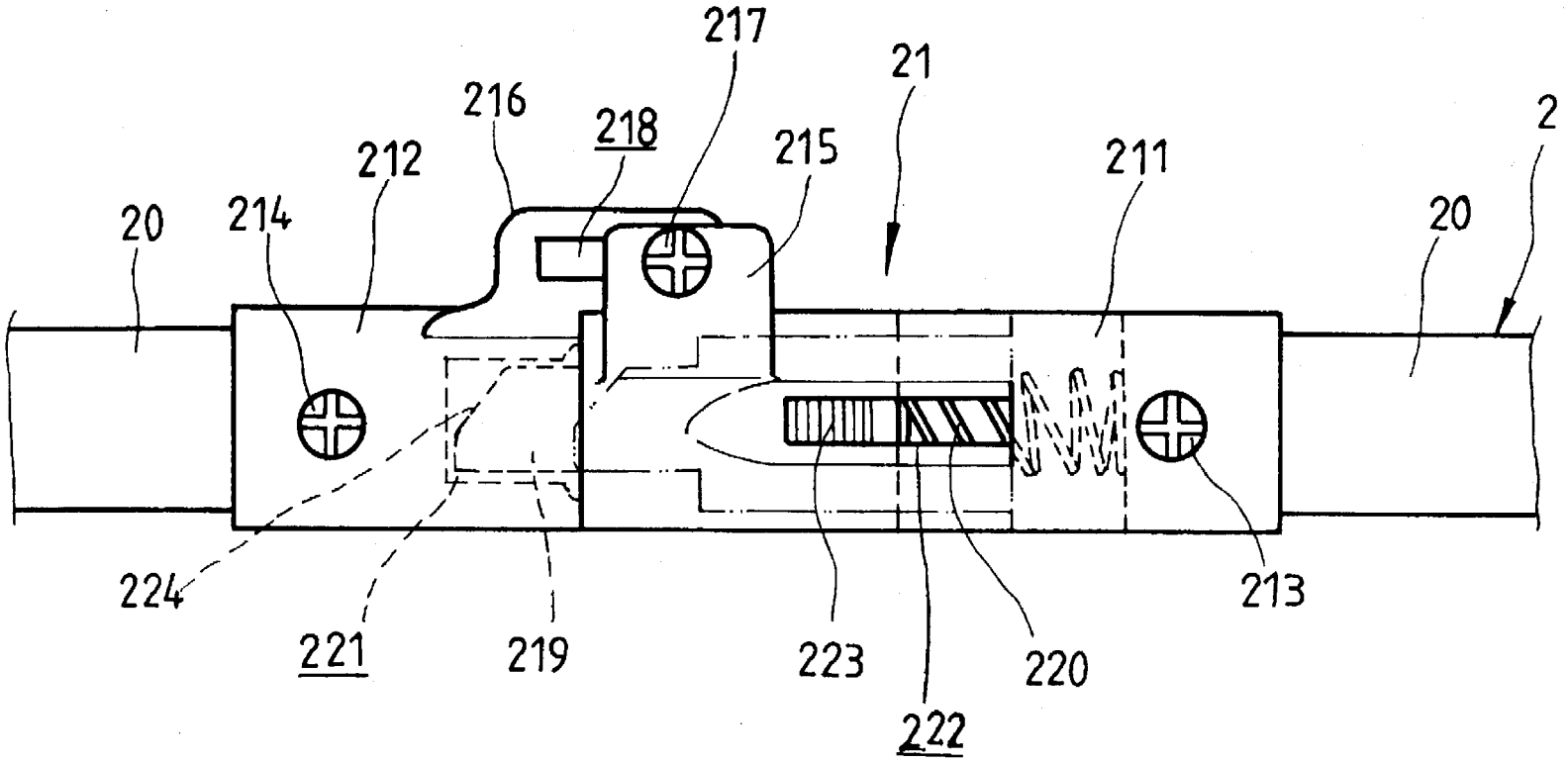
FIG. 6 is a side view of a lower central joint for a lower horizontal rod in the expanded condition, which lower horizontal rod partially constitutes the bed rail of the present invention.
Figure 7:
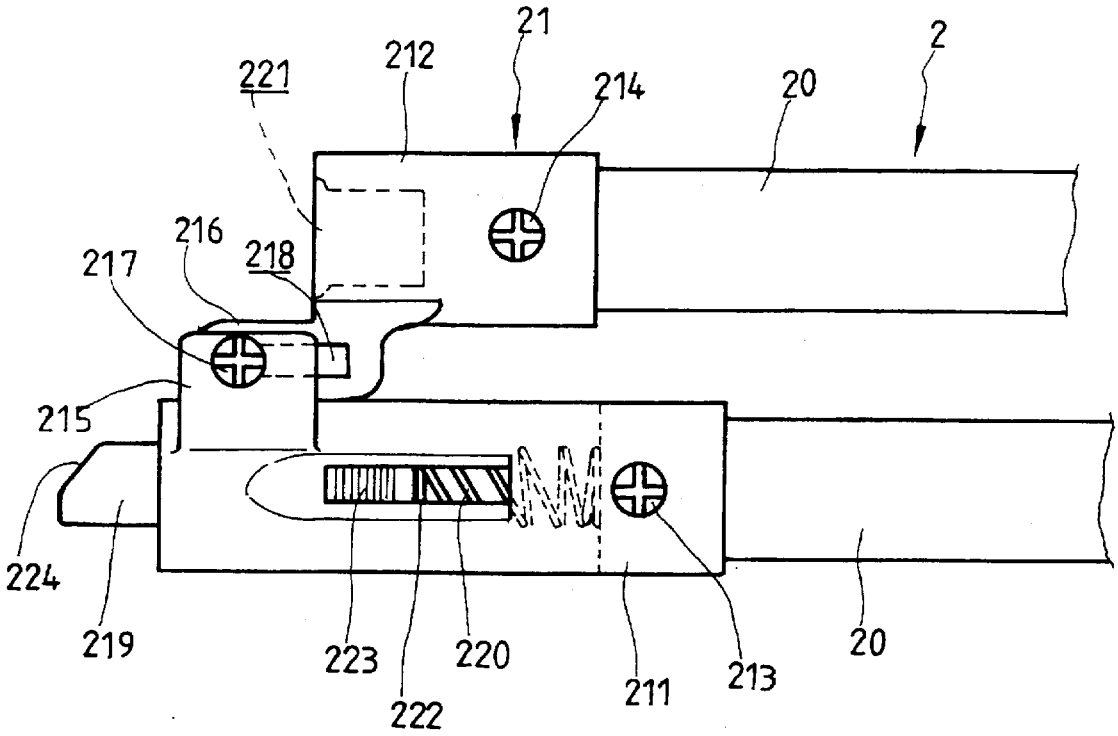
FIG. 7 is a side view showing the lower central joint of the lower horizontal rod in the collapsed condition.

With reference to FIGS. 6 and 7, the lower central joint 21 comprises a first tubular member 211 fit onto and fixed on the inner end of a first one of the sections 20 of the lower horizontal rod 2 by means of for example a screw 213 and a second tubular member 212 fit onto and fixed on the inner end of a second one of the sections 20 of the lower horizontal rod 2 by means of for example a screw 214. The first tubular member 211 comprises a pair of spaced walls 215 to receive therein an extension 216 of the second tubular member 212 with a pivot 217 extending therethrough to define a knuckle joint. The extension 216 of the second tubular member 212 may be provided with an elongated slot 218 through which the pivot 217 extends to adjust the linear location of the pivot 217.

A latch 219 is movably received within the first tubular member 211 and biased by a spring 220 to partially project out of the first tubular member 211 to be received within a cavity 221 formed in the second tubular member 212 so as to have the first and second tubular members 211 and 212 to engage each other and thus keeping the knuckle joint in the expanded position where the sections 20 of the lower horizontal rod 2 are in alignment with each other, as shown in FIGS. 1 and 6.

The first tubular member 211 is provided with an elongated slot 222 through which a manual knob 223 is received to be user accessible. The manual knob 223 extends into the first tubular member 211 to engage the latch 219 by any known means so that by manually moving the knob 223 against the spring 220, the latch 219 may be withdrawn out of the cavity 221 of the second tubular member 212 and retracted into the first tubular member 211 to disengage the first tubular member 211 from the second tubular member 212.

The latch 219 may be provided with an inclined camming end face 224 for facilitating insertion into the cavity 221 of the second tubular member 212.

With reference to FIGS. 9 and 10, since the pivotal connection between the upright rods 3 and the first and second lower corner joints 5 and 50 allows the upright rods 3 and thus the upper horizontal rod 1 connected between the upper ends of the upright rods 3 to make at least half a full turn, the upper horizontal rod 1 is rotatable approximately 180 degrees downward, as indicated in phantom lines of FIG. 10 to such a position (rail open position) where the access to the bed is completely not interfered with by the bed rail. This allows parents to pick up young babies lying on the bed without being interfered with by the bed rail.

The bed rail of the present invention further comprises a resilient cover sheet 8 substantially fully covering the rectangle defined by the upright rods 3 and the upper and lower horizontal rods 1 and 2. The cover sheet 8 may comprises a channel 81 and 82 along upper and lower edges formed by fold-back of the edge of the cover sheet 8 through which the upper and lower horizontal rods 1 and 2 may extend to secure the cover sheet 8 on the bed rail. Preferably, a net-like central portion 80 is provided on the cover sheet 8.

In collapsing the bed rail of the present invention from the expanded condition shown in FIG. 1, the lower horizontal rod 2 is first removed from the support member 51 and the support tube 501 and then folded about the knuckle joint 21. The bed rail, with the lower horizontal rod 2 removed, is then collapsed by folding the sections 12 of the upper horizontal rod 1 about the upper central joint 11. At this time, the section 12 of the upper horizontal rod 1 are also rotated about pivots 60 of the upper corner joints 6 so as to have the sections 12 of the upper horizontal rod 1 to substantially overlap the upright rods 3. The upright rods 3, as well as the overlapping section 12 are then rotated about the pivots 54 of the lower corner joints 5 and 50 to substantially overlap the transverse bars 4, as shown in FIG. 2.

Although a preferred embodiment has been described to illustrate the present invention, it is apparent that changes and modifications in the specifically described embodiment can be carried out without departing from the scope of the invention which is intended to be limited only-by the appended claims.

What is claimed is:

1. A bed rail structure comprising:

two upright rods, each having an upper end to which an upper corner joint is fixed and a lower end pivoted to a lower corner joint so as to be rotatable relative to the lower corner joint;

an upper horizontal rod extending between the upper corner joints of the upright rods, comprising two first sections, each having an inner end pivoted to an upper central joint so as to be rotatable relative to each other between an expanded condition and a collapsed condition and an outer end pivoted to the respective upper corner joint;

first retaining means provided on each of the first sections of the upper horizontal rod to maintain the first sections in the expanded condition and first releasing means for releasing the first sections from the expanded condition and allowing the first sections to be moved to the collapsed condition;

a lower horizontal rod extending between the lower corner joints of the upright rods, comprising two second sections having inner ends pivoted to each other by means of a lower central joint to be rotatable relative to each other among an expanded condition, a collapsed condition and a rail open condition and outer ends releasably connected to the respective lower corner joints;

second retaining means provided on the second sections of the lower horizontal rod to maintain the second sections in the expanded condition and second releasing means for releasing the second sections from the expanded condition and allowing the second sections to be moved to the collapsed condition;

third retaining means for releasably retaining the outer end of a first one of the second sections to a first one of the lower corner joints and fourth retaining means for releasably retaining the outer end of a second one of the second sections to a second one of the lower corner joints;

a transverse bar fixed to and extending from each of the lower corner joints in a direction substantially normal to the upright rod and the lower horizontal rod, adapted to be placed and held under a matrix; and a resilient cover sheet extending between the upper and lower horizontal rods and between the upright rods.

2. The bed rail structure as claimed in claim 1, wherein the upper central joint comprises a hollow member having a U-shaped cross section having two spaced walls defining therebetween a space having two opposite ends for respectively receiving the inner ends of the first sections therein, a pivot pin extending through the two walls and the inner end of each of the first sections to pivot the first section to the upper central joint.

3. The bed rail structure as claimed in claim 2, wherein the first retaining means comprises two opposite projections movably received within a hollow portion of the inner end of the first section, the projections being extendible out of the first section and receivable within corresponding holes formed on the walls of the upper central joint to retain the first section in the expanded condition relative to the upper central joint.

4. The bed rail structure as claimed in claim 3, wherein the first retaining means comprises a leaf spring in the form of a U having two legs on which the two opposite projections are fixed so as to be biased into the holes of the walls of the upper central joint.

5. The bed rail structure as claimed in claim 4, wherein the first releasing means comprises a U-shaped member to be fit over and fixed on the upper central joint, the U-shaped member comprises two opposite, manually-deformable tabs which are movable into the space defined between the two walls of the upper central joint through openings formed on the upper central joint and contact and inward press free ends of the legs of the leaf spring for forcing the projections to move into the first section and thus releasing the first section from the upper central joint to allow the first section to move to the collapsed condition.

6. The bed rail structure as claimed in claim 5, further comprising a stop pin extending through and fixed in holes formed on the two walls of the upper central joint with which the inner end of the first section is brought into contact when the first section is moved to the collapsed condition.

7. The bed rail structure as claimed in claim 1, wherein the lower central joint comprises a first tubular member fit onto and fixed to the inner end of the first one of the second sections and a second tubular member fit onto and fixed to the inner end of the second one of the second sections, the first tubular member having two spaced walls formed thereon to receive therebetween an extension of the second tubular member with a pin extending therethrough so as to define a knuckle joint.

8. The bed rail structure as claimed in claim 7, wherein the extension of the second tubular member comprises an elongated slot through which the pin connecting the first and second tubular members extends.

9. The bed rail structure as claimed in claim 7, wherein the second retaining means comprises a spring-loaded latch which is disposed within the first tubular member and biased by a spring to engage a cavity formed on the second tubular member.

10. The bed rail structure as claimed in claim 9, wherein the latch comprises an inclined camming face provided on an outer end thereof for facilitating the engagement of the latch with the cavity.

11. The bed rail structure as claimed in claim 8, wherein the second releasing means comprises a manually-movable knob movably received within an elongated slot formed on the first tubular member and fixed to the latch to allow manual movement of the latch against the biasing spring.

12. The bed rail structure as claimed in claim 1, wherein the third retaining means comprises a support member in the form of an open channel extending from the first one of the lower corner joints toward the second one of the lower corner joint member, the first one of the second section comprising two spring-biased retainer pins arranged inside and partially extending out of the second section to be received within corresponding holes formed on the support member to retain the second section to the support member, the second section being releasable from the support member by forcing the retainer pins into the second section against the biasing spring.

13. The bed rail structure as claimed in claim 12, wherein the open channel comprises an open upper side defined by two opposite and spaced edges and wherein the support member comprises two circumferentially extending guide slots, diverging toward the edges of the open channel.

14. The bed rail structure as claimed in claim 1, wherein the fourth retaining means comprises a support tube fixed to and extending from the second one of the lower corner joints toward the first one of the lower corner joints, the support tube having an open free end for receiving the outer end of the second one of the second sections therein, the second one of the second sections comprising two spring-biased retainer pins arranged inside and partially extending out of the second section to be received within corresponding holes formed on the support tube to retain the second section in the support tube, the second section being releasable from the support tube by forcing the retainer pins into the second section against the biasing spring.

15. The bed rail structure as claimed in claim 14, wherein the support tube comprises two axially extending guide slots, diverging toward the open end of the support tube.

16. The bed rail structure as claimed in claim 1, wherein the lower end of each of the upright rods comprises fifth retaining means to selectively maintain the upright rod in the expanded condition and the collapsed condition.

17. The bed rail structure as claimed in claim 16, wherein the fifth retaining means comprises a spring plate arranged within the upright rod and having a retainer pin fixed thereon to be biased thereby to partially extending out of the upright rod so as to make the retainer pin retractable into the upright rod by applying a force thereon against the spring plate and wherein the lower corner joint comprises two opposite walls defining therebetween a spacing for receiving the lower end of the upright rod therein with a pivot pin extending therethrough to pivot the lower end of the upright rod to the walls so as to allow the upright rod to be rotatable about the pivot among the expanded condition, the folded condition and the rail open condition, one of the walls comprising a first hole corresponding to the expanded condition to receive the retainer pin of the upright rod therein for maintaining the upright rod in the expanded condition, the one of the walls further comprising a second hole corresponding to the collapsed condition to receive the retainer pin of the upright rod therein for maintaining the upright rod in the collapsed condition.

18. The bed rail structure as claimed in claim 17, wherein the spring plate comprises a control peg partially projecting out of the upright rod to be depressible by a user for retracting the retainer pin of the upright rod and thus releasing the upright rod.

* * * * *